United States Patent [19]

Guenther

[11] Patent Number: 4,767,111

[45] Date of Patent: Aug. 30, 1988

[54] APPARATUS FOR FRAMING GARMENT PORTIONS IN HOOPS

[76] Inventor: Ruth P. Guenther, 1226 Prairie Dr., Racine, Wis. 53406

[21] Appl. No.: 120,923

[22] Filed: Nov. 16, 1987

Related U.S. Application Data

[63] Continuation-in-part of Ser. No. 904,667, Sep. 8, 1986, abandoned.

[51] Int. Cl.[4] ..... B23Q 3/00

[52] U.S. Cl. ..... 269/303; 269/319; 269/901; 248/454

[58] Field of Search ..... 269/289 R, 303–305, 269/315, 318, 319, 901; 108/6, 9; 248/447, 454; 29/448, 559

[56] References Cited

U.S. PATENT DOCUMENTS

| | | | |
|---|---|---|---|
| D. 244,755 | 6/1977 | Bard | D15/66 |
| 1,797,889 | 3/1931 | Wiberg | 248/454 |
| 4,292,748 | 10/1981 | Miller | 248/444 |
| 4,466,601 | 8/1984 | Raines | 269/303 |
| 4,545,127 | 10/1985 | Barry | 33/180 R |
| 4,561,177 | 12/1985 | Rancer | 29/721 |
| 4,620,687 | 11/1986 | Bishop | 248/454 |

*Primary Examiner*—Frederick R. Schmidt
*Assistant Examiner*—Judy J. Hartman
*Attorney, Agent, or Firm*—Peter N. Jansson, Ltd.

[57] ABSTRACT

An apparatus for facilitating the framing of target portions of garments in hoops for attachment to embroidery machines or the like. The apparatus includes a workboard adjustably mounted to a base and movable between garment-mounting and hooping positions, a garment-supporting form secured to the workboard, and members for removably attaching one of the hoops.

20 Claims, 3 Drawing Sheets

APPARATUS FOR FRAMING GARMENT PORTIONS IN HOOPS

RELATED APPLICATION

This application is a continuation-in-part of U.S. application Ser. No. 904,667, filed Sept. 8, 1986; now abandoned.

FIELD OF THE INVENTION

This invention is related generally to the framing of fabrics in embroidery hoops and the like and, more particularly, to devices and methods for facilitating such framing of portions of garments.

BACKGROUND OF THE INVENTION

The use of high-speed program-driven embroidery machines has greatly increased the efficiency of embroidery operations. Embroidering, which previously had been very time-consuming and difficult, is now carried out automatically and very quickly once the fabric to be embroidered is properly mounted.

Mounting of the fabric to be embroidered, usually referred to as framing or hooping, involves engagement of the fabric on and across a pair of male and female embroidery hoops which hold the target area of fabric taut and flat. Once the fabric is framed with hoops in this manner, the hoops may be secured to an embroidery machine. The female or outer hoop has means thereon to engage the embroidery machine after framing of the fabric.

While primary reference is made herein to embroidering and embroidery machines, it should be understood that this invention is also applicable to fabric framing for attachment to other types of machines which apply letters, artwork and the like, and to framing for other purposes.

Framing of the fabric is primarily a manual operation. While fabric framing is difficult and tedious enough for any sort of fabric, it is particularly difficult to frame portions of garments. In embroidery shops using the new high-speed embroidering machines, framing of garment portions in preparation for embroidering has become a source of inefficiency.

Garments, particularly shirts, jackets and other shirt-like garments, are quite difficult to frame for several reasons. One principal reason is that they have complex shapes and curvatures. Furthermore, it is often particularly difficult with garments to locate the proper target area for framing and subsequent embroidering. As a result, the framing of garments in many cases is carried out at a speed which is inadequate to supply high-speed embroidery machines.

Accurate garment framing frequently requires a number of steps, such as pinning, taping, measuring and a good deal of guessing, before the male and female hoops are engaged to frame the target portion of a garment, such a jacket.

Various methods and devices have been developed to facilitate the hooping of fabrics. Included in the prior art are U.S. Pat. Nos. 4,561,177 (Rancer), D244,755 (Bard), 4,545,127 (Barry), and 4,292,748 (Miller). The Rancer patent relates to a device for automatic insertion of the male hoop into the female hoop to free the hands of the operator to hold the fabric in the proper place over a female hoop secured to a work table. Also included in the prior art are various flat boards which are used, in effect, as work surfaces for framing.

The methods and devices of the prior art for framing garment portions have substantial problems and disadvantages. In such framing, garments are frequently improperly oriented unless numerous manual steps are taken to adjust and readjust the position and orientation of the garment before engagement of the female and male hoops.

In framing the upper back portion of a shirt, jacket or other shirt-like garment, the natural lines of the garment often require repeated readjustment before finding the proper location and obtaining the flat condition needed for proper framing and subsequent embroidering. Uneven gathers in the portions of the garment immediately surrounding the area to be framed pose a particular problem. Finding the right target location and orientating the garment properly are difficult tasks using prior art devices and methods.

There is clearly a need for an improved apparatus and method for facilitating framing of garments, particularly shirts, jackets and other shirt-like garments, in order to facilitate operations in embroidery shops and the like.

OBJECTS OF THE INVENTION

It is an object of this invention to provide an improved garment hooping apparatus and method overcoming some of the problems and shortcomings of the prior art.

Another object of this invention is to provide an improved apparatus and method for framing shirts, jackets and other shirt-like garments.

Another object of this invention is to provide an improved garment framing apparatus and method which substantially increase the efficiency of the framing operation and reduce framing errors.

Another object of this invention is to provide, an improved framing apparatus for garments which facilitates locating the appropriate target portion of the garment and properly orienting it for framing in preparation for subsequent embroidering.

Yet another object of this invention is to provide an improved apparatus for framing target portions of shirt-like garments which is adaptable to garments of varying width.

Another object of this invention is to provide a conveniently usable apparatus for hooping garments, such as shirts, jackets and other shirt-like garments, which allows the garments to assume their natural shapes during hooping.

These and other important objects will be apparent from the descriptions of this invention which follow.

SUMMARY OF THE INVENTION

This invention is an improved apparatus and method for framing target portions of garments, particularly shirt-like garments, in female and male hoops for subsequent operations such as embroidering and the like. A garment is placed on the apparatus of this invention to facilitate framing by female and male hoops. The female hoop has means for attachment to the apparatus for framing and such attachment means is also used for attachment to machines carrying out subsequent operations on the garment such as programmed embroidering.

The apparatus of this invention, in one form, includes a base, a workboard mounted to the board and extending therefrom, preferably at an angle above the horizontal, to a distal end, a garment-supporting shoulder form secured to the workboard, preferably a shoulder form secured along the distal end, and means on the workboard for removably attaching one of the hoops. This combination allows a shirt, jacket or other shirt-like garment to be draped over the workboard in the proper position and orientation, thus facilitating the framing operation, as hereafter described.

The workboard extends upwardly from the base at, an angle from a proximal end to a distal end. The workboard is mounted to the base by mounting means along the proximal end for independent support of the workboard which allows complete clearance all around the workboard from its distal end substantially to its proximal end. The garment-supporting shoulder form includes opposed upwardly-converging angled upper edge portions to simulate human shoulders.

In highly preferred embodiments, the workboard is adjustably mounted to the base and movable between a garment-mounting position and a hooping position. The garment-mounting position is preferably substantially upright, that is, angled well above the hooping position. The hooping position is preferably closer to horizontal.

Preferred embodiments include means to hold the workboard in its more upright garment-mounting position and means to support the workboard in its lower hooping position. The support means is preferably a stop which is secured to the base and positioned for engagement by the workboard to define a lower angle with respect to the horizontal than the workboard takes in its garment-mounting position.

The workboard proximal end preferably is connected to the base by hinge means. The workboard pivots about such hinge means between its upright garment-mounting position and its lower hooping position. The aforementioned means to hold the workboard in the upright garment-mounting position is preferably part of the hinge means, which may include a spring-supported cam or other structure preventing free rotation of the workboard about the hinge means. This allows the workboard to stay in the upright position until pushed downwardly to its hooping position.

As noted, the garment-supporting shoulder form is preferably secured to the workboard along the distal end. In the upright garment-mounting position of the workboard, a shirt, jacket, or other shirt-like garment can hang on the shoulder hanger in a natural fashion around the workboard, which greatly facilitates the framing operation.

In a highly preferred embodiment of this invention, the garment-supporting shoulder form has opposite sides of different shapes to simulate the front and back of the human shoulders, which of course have different curvatures. Certain of such preferred embodiments include means to selectively secure the garment-supporting shoulder form to the workboard in either a front or a back position.

The workboard has opposite edges (sides) which extend between its proximal and distal ends and preferably has extension means along such opposite sides to accommodate garments of varying widths. Such extension means can be in a variety of forms. They are particularly helpful in spreading the material just above the drawn-in waistbands of athletic jackets and the like. The extension means and the shoulder form together allow the liner and outer material to lie in proper surface-to-surface relationship, both of them being as if in proper position on a human torso.

One highly preferred extension means is a pair of arms, each one being pivotably secured at one end of such arm to the workboard along the opposite sides thereof. Such arms (or wings) can be pivoted outwardly in varying degrees to take up slack in a shirt-like garment which is on the workboard. As will be explained later, this facilitates the framing operation. Such arms function as adjustable garment-spreading means.

The hoop attachment means on the workboard may be in various forms. Such hoop attachment means is preferably a few blocks or other pieces projecting upwardly from the workboard to form a specific location where the connecting means secured to the hoop can be inserted. This may involve two spaced projections locating the hoop between them at the center position along the distal edge and another projection determining the proper spacing from the edge. Such projections will capture the female hoop in fixed position. And, in such fixed position, the female hoop will be flat against the workboard.

In preferred embodiments, the hoop attachment means on the workboard is near the distal end, immediately adjacent to (just below) the garment-supporting shoulder form. Such positioning allows hooping of the upper back portion of a shirt, jacket or other shirt-like garment. This combination of elements allows easy positioning of the garment for accurate framing of the proper target area. The hoop attachment means can be located elsewhere on the workboard to facilitate framing of other target areas of such garments.

In certain highly preferred embodiments, particularly those of the type allowing mounting of the shoulder form in either a front or a back orientation, the hoop-engagement means is removably connected to the workboard such that it may be selectively positioned thereon for framing different target portions. For example, when it is desired to place embroidery on the left or right front chest portion of a jacket, the hoop-engagement means is attached at an off-center position to allow hooping at the desired place. Or, if it is desired to place embroidery in a centered position on the back of the jacket, as is usually the case, the hoop-engagement means may be attached to the workboard at the top center position as earlier described.

The apparatus and method of this invention eliminate many of the time-consuming steps required for framing garments. In particular, they eliminate much of the guesswork and the need for frequent adjustments and readjustments of a garment until the proper and position and flat condition of the area to be framed is achieved.

The method of this invention will be described with reference to a jacket which is being framed for embroidering of artwork and words onto a large portion of the upper back thereof.

The method of the invention includes first securing one hoop (the female hoop) to a workboard of the type just described. It is attached to the hoop attachment means which is along the distal end of the workboard.

With the workboard in an upright garment-mounting position, the jacket is hung on the shoulder form, affixed at the distal end of the workboard just above the hoop attachment means, with its back portion on top of the workboard. With the jacket hanging properly, slack (both in the outer fabric and in any lining) may be removed by pivoting the earlier described lateral arms outwardly to the extent required. Such slack removal means is particularly helpful for lined jackets having gathered elastic or non-elastic waist bands.

When the jacket is hanging in a properly centered position and orientation, the workboard is pivoted downwardly to the lower hooping position, where the workboard is supported with its hoop side up, and in this instance, with the back of the jacket extending over the workboard and over the female hoop. In such lower position, the workboard is supported on a stop means at a convenient work angle, preferably just above horizontal. If desirable, the removal of slack by use of the pivoting arms along the sides of the workboard can be carried out in the hooping position.

The next step in the method is to manually smooth the general target portion of the garment -- that is, the portion to be framed by the hoops, being sure to eliminate any doubled-over portions in any lining. At the same time, a final determination is made of exactly the proper portion of the garment to be framed and the final proper orientation of such target portion is also achieved. These steps are made very easy by virtue of the fact that the garment, when mounted, was made to hang naturally, and the fact that its major slack has already been removed.

Then the second hoop, preferably the male hoop, is engaged with the first hoop to frame the target area. The two hoops and the garment attached thereto are detached from the apparatus of this invention by detaching the first hoop from the workboard. The framed garment can then be moved to the embroidery machine, or other machine for subsequent operations.

DETAILED DESCRIPTION OF PREFERRED EMBODIMENTS

Figure 1:
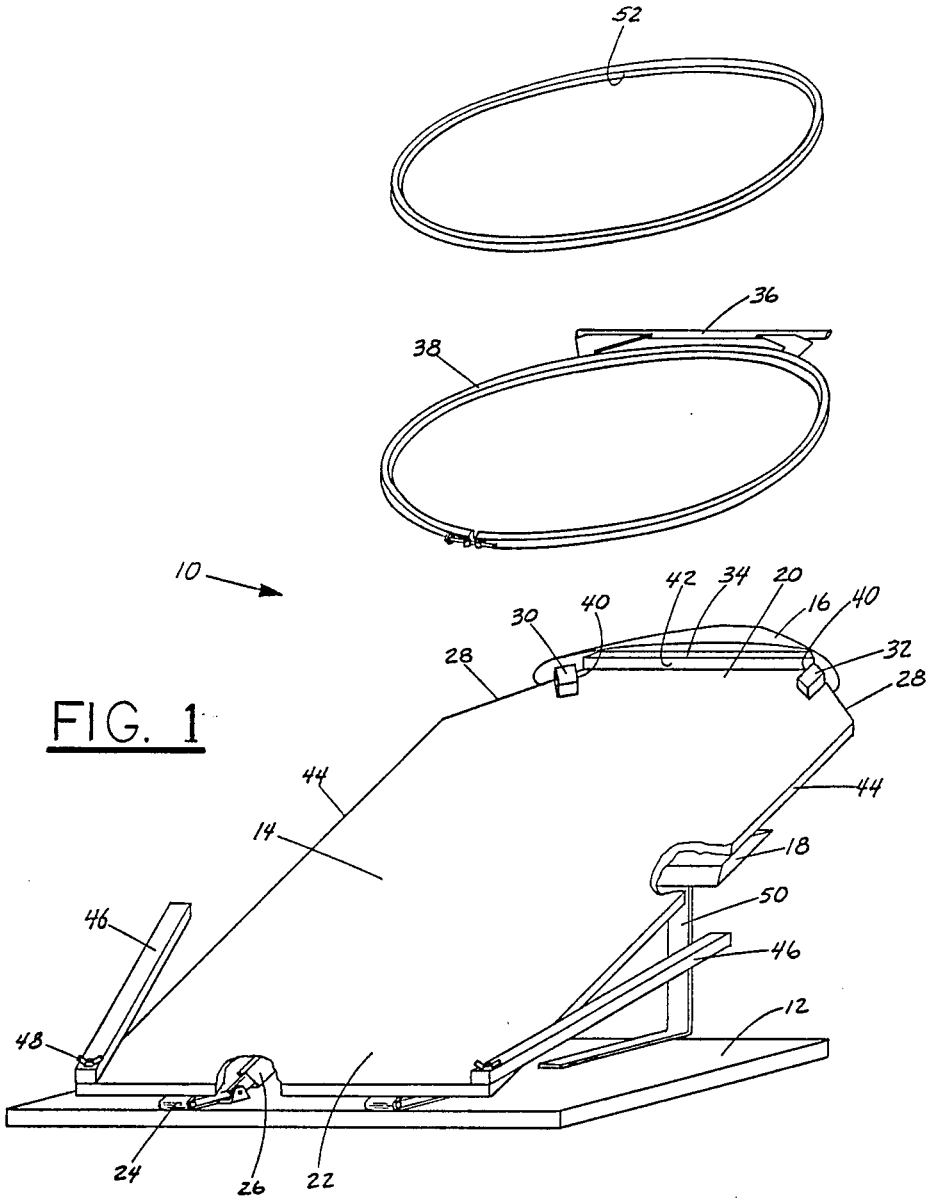
FIG. 1 is a partially broken-away exploded perspective view of a preferred embodiment of this invention with its workboard in the hooping position.

The figures illustrate a preferred framing apparatus 10 for framing target portions of shirt-like garments, such as shirts, jackets, and the like, in female and male hoops for subsequent application of lettering or artwork by embroidering or otherwise. Framing apparatus 10 is an assembly including a base 12, a workboard 14, a garment-supporting shoulder form 16, a stop member 18, and various connecting parts.

Base 12 is a flat board for supporting the remaining portions of framing apparatus 10. Base 12 provides such support by resting on a table or other support surface. Base 12 preferably is fairly heavy to provide stability to framing apparatus 10, or it may be attached to its supporting surface or structure.

Workboard 14 has a distal end 20 and a proximal end 22. Workboard 14 is mounted to base 12 by hinges secured along proximal end 22. Such hinges include a pair of primary hinges 24 widely space along proximal end 22 and an adjacent pair of support hinges 26, one next to each of the primary hinges 24.

Support hinges 26 have internal springs and camming means (not shown) which hold workboard 14 at the chosen pivotal position with respect to base 12. Such springs and camming means may allow preferential pivotal location of workboard 14 at its two positions of use -- that is, the upright garment-mounting position shown in FIGS. 2 and 3 and the lower hooping position shown in FIGS. 4 and 5.

Shoulder form 16 is rigidly attached to workboard 14 along distal end 20. Distal end 20 includes tapered edge portions 28 which accommodate the location of shoulder form 16 therealong and accommodate the draping of a garment over workboard 14.

Also along distal end 20 are three projections—30, 32 and 34, positioned and located to removably capture the attachment member 36 connected along one side of female hoop 38. Side projections 30 and 32 bracket the opposite ends of attachment member 36, and have slanted surfaces 40 to keep attachment member 36 from sliding away from distal end 20. Top projection 34 has a lower surface 42 which engages the top edge of attachment member 36 to hold it firmly against side projections 30 and 32.

Workboard 14 has opposite sides 44. A pair of garment-spreading arms 46 are pivotably attached along opposite sides 44 by pivot mounts 48. Arms 46 can be pivoted such that they extend beyond the sides of workboard 14, as shown in FIGS. 1, 4 and 5, and this allows extra slack in a garment to be taken up so that it does not interfere with the framing operation.

Stop member 18 is secured to base 12 in fixed position by a pair of mounting brackets 50. Stop member 18 is angled with respect to base 12 at an angle equal to the desired angle of workboard 14 in its hooping position. When workboard 14 is pivoted to such position, it engages stop member 18, and stop member 18 provides good support for workboard 14 during framing.

Figure 2:
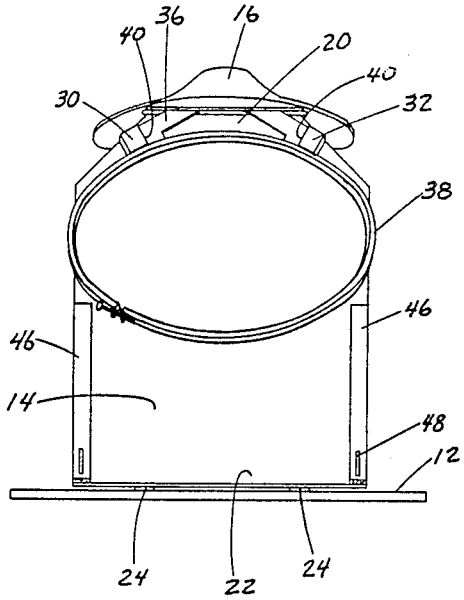
FIG. 2 is a reduced front elevation of the apparatus of FIG. 1, but having the workboard in its upright garment-mounting position.
Figure 3:
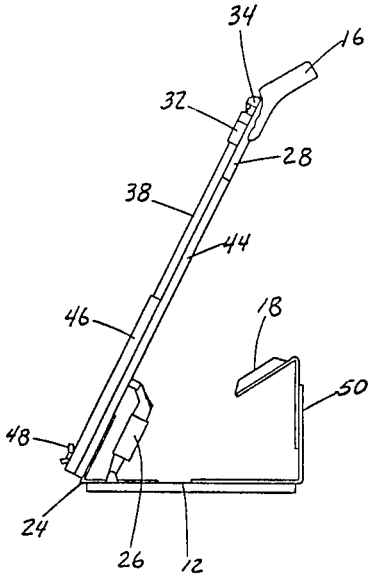
FIG. 3 is a right side elevation of FIG. 2.

FIGS. 2 and 3 illustrate workboard 14 in its upright garment-mounting position. Female hoop 38 is secured in place by means of projections 30, 32 and 34. Arms 46 are in their retracted positions.

Figure 4:
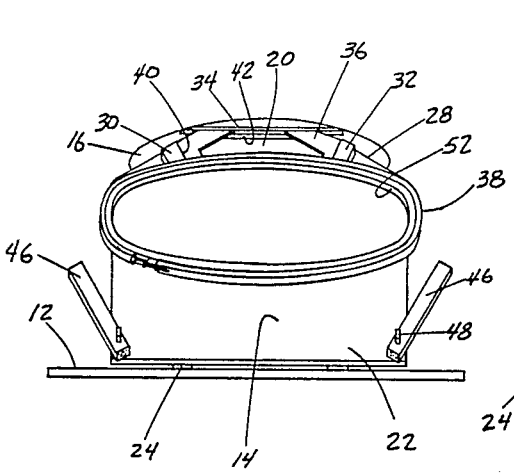
FIG. 4 is another front elevation, but showing the workboard in its hooping position and with its lateral arms extended as in FIG. 1.
Figure 5:
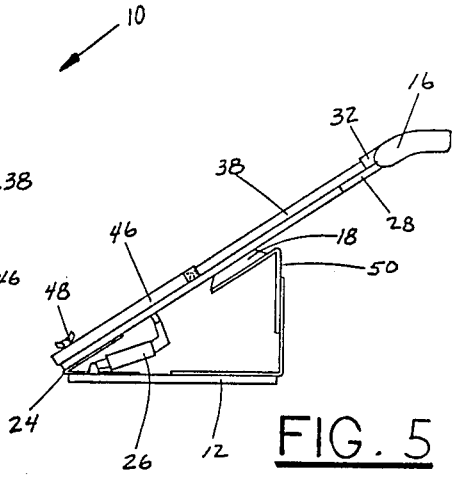
FIG. 5 is a right side elevation of FIG. 4.

FIGS. 1, 4 and 5 illustrate workboard 14 in the lower hooping position. Although no garment is shown, male hoop 52 is shown in position as if engaged with female hoop 38 and framing a portion of a garment. Arms 46 are in their partially extended positions in which they would be as needed to remove slack just prior to insertion of male hoop 52.

Figure 6:
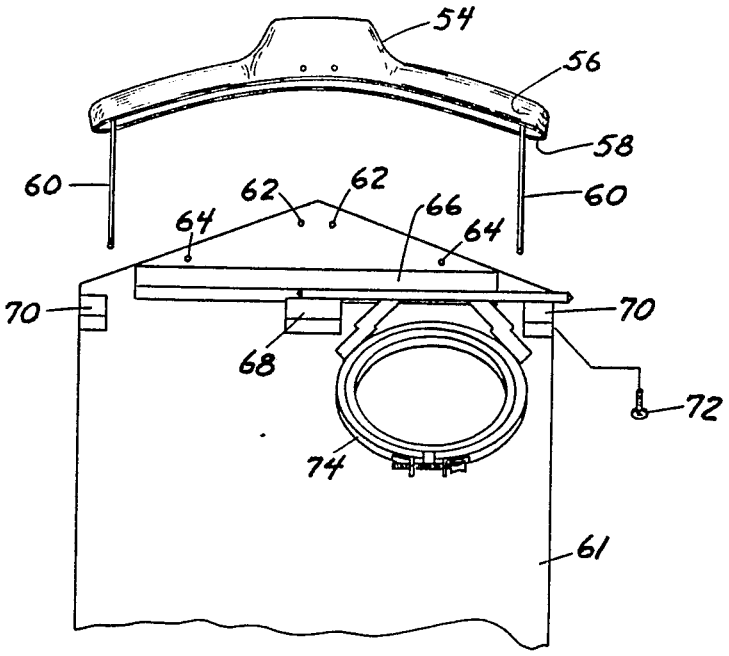
FIG. 6 is a a fragmentary partially exploded face view of an alternate form of the workboard.

As with shoulder form 16, shoulder form 54 shown in FIG. 6 has opposite front and back sides 56 and 58 which have different shapes to simulate the front and back of the human shoulders. Shoulder form 54 also has a U-shaped member secured to it which has a pair of thin legs 60 extending therefrom in position for insertion into holes (not shown) along the upper edge of the workboard 61. Legs 60 allow shoulder form 54 to be attached to workboard 61 with either front side 56 or back side 58 toward the operator. In each case, shoulder form 54 will be fixed so that it does not rotate.

FIG. 6 also illustrates that the hoop-engagement means may be removably connected to workboard 61 for selective positioning thereon, to allow framing of different target portions. Workboard 61 has holes 62 for a top projection like projection 34 and holes 64 for side projections like projections 30 and 32. Such projections may be removably attached to workboard 61 by thumbscrews 72 which engage the projections from the rear surface of workboard 61.

Such projections may be removed simply by unscrewing thumbscrews 72 from the rear of workboard 61. Then the same or other projections, such as lower top projection 66, center bottom projection 68, and lower side projections 70 may be connected to workboard 61 at other set positions by means of thumbscrews 72 and other holes (not shown). These projections or projection locations allow another hoop set 74 (preferably smaller than hoops 38 and 52, to be removably engaged with workboard 61. This facilitates framing of either the left front side of a shirt-like garment (as shown) or the right front side thereof.

The apparatus of this invention can be made using readily available parts and materials. It is preferred that workboard 14, base 12 and stop member 18 be made of wood, although plastics and many other materials are equally acceptable. Projections 30, 32 and 34 may be attached to workboard 14 or may be integrally formed therewith. Likewise, shoulder form, although preferably attached, may be secured to workboard 14 by being integrally formed therewith. The hinges and other connectors are all of readily available types.

While the principles of this invention have been described in connection with specific embodiments, it should be understood clearly that these descriptions are made only by way of example and are not intended to limit the scope of the invention.

What is claimed:

1. Apparatus for framing target portions of shirt-like garments comprising:

a base;

a workboard extending upwardly from the base at an angle from a proximal end to a distal end, the workboard mounted to the base by mounting means along the proximal end for independent support of the workboard which allows complete clearance all around the workboard from its distal end substantially to its proximal end;

garment-supporting means secured to the workboard at the distal end to simulate human shoulders, including opposed upwardly-converging angled upper edge portions;

a first hoop on the workboard;

an attachment member affixed to the first hoop for removably securing it to the workboard; and hoop-engagement means on the workboard removably engaging the attachment member to position and secure the first hoop on the workboard at a predetermined position with respect to the shoulder form, whereby garment hooping can be carried out quickly and accurately with the garment hanging in proper position by applying a mating hoop to the first hoop on an opposite side of the garment.

2. The apparatus of claim 1 wherein the workboard has opposite sides and a pair of adjustable garment-spreading means secured to the workboard along the opposite sides to accommodate garments of varying width.

3. The apparatus of claim 2 wherein the garment-spreading means comprises a pair of arms each pivotably secured at one end to the workboard.

4. The apparatus of claim 3 wherein the arms are pivotably secured to the workboard at the proximal end thereof.

5. The apparatus of claim 1 wherein the workboard is adjustably mounted to the base such that it is movable between a garment-mounting position and a hooping position.

6. The apparatus of claim 5 wherein mounting means comprises hinge means.

7. The apparatus of claim 5 further comprising means to support the workboard in the hooping position, the hooping position being lower than the garment-mounting position.

8. The apparatus of claim 7 wherein the support means comprises a stop secured to the base and positioned for engagement by the workboard.

9. The apparatus of claim 8 wherein the workboard has opposite sides and a pair of adjustable garment-spreading means secured to the workboard along the opposite sides to accommodate garments of varying width.

10. The apparatus of claim 9 wherein the garment-spreading means comprises a pair of arms each pivotably secured at one end to the workboard.

11. The apparatus of claim 10 wherein the arms are pivotably secured to the workboard at the proximal end thereof.

12. The apparatus of claim 1 wherein the garment-supporting means has opposite sides of different shapes to simulate the front and back of the human shoulders and further comprising means to selectively secure the garment-supporting means to the workboard in either a front or a back position.

13. The apparatus of claim 12 wherein the hoop-engagement means is removably connected to the workboard such that the first hoop may be selectively positioned thereon for framing different target portions.

14. The apparatus of claim 13 wherein the workboard has opposite sides and a pair of adjustable garment-spreading means secured to the workboard along the opposite sides to accommodate garments of varying width.

15. The apparatus of claim 14 wherein the garment-spreading means comprises a pair of arms each pivotably secured at one end to the workboard.

16. The apparatus of claim 15 wherein the arms are pivotably secured to the workboard at the proximal end thereof.

17. The apparatus of claim 13 wherein the workboard is adjustably mounted to the base such that it is movable between a garment-mounting position and a hooping position.

18. The apparatus of claim 17 wherein mounting means comprises hinge means.

19. The apparatus of claim 17 further comprising means to support the workboard in the hooping position, the hooping position being lower than the garment-mounting position.

20. The apparatus of claim 19 wherein the support means comprises a stop secured to the base and positioned for engagement by the workboard.

* * * * *